US010000728B2

(12) United States Patent
Goncalves Rodrigues

(10) Patent No.: US 10,000,728 B2
(45) Date of Patent: Jun. 19, 2018

(54) CLEANING COMPOSITION WITH PROPELLANT

(71) Applicant: S.C. Johnson & Son, Inc., Racine, WI (US)

(72) Inventor: Juan Jose Goncalves Rodrigues, Oak Creek, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 89 days.

(21) Appl. No.: 15/171,629

(22) Filed: Jun. 2, 2016

(65) Prior Publication Data

US 2017/0015959 A1 Jan. 19, 2017

Related U.S. Application Data

(60) Provisional application No. 62/193,905, filed on Jul. 17, 2015.

(51) Int. Cl.

| | |
|---|---|
| ***C11D 1/00*** | (2006.01) |
| ***C11D 1/72*** | (2006.01) |
| ***C11D 1/722*** | (2006.01) |
| ***C11D 7/30*** | (2006.01) |
| ***C11D 17/00*** | (2006.01) |
| ***C11D 3/20*** | (2006.01) |

(Continued)

(52) U.S. Cl.

CPC ..... *C11D 17/0043* (2013.01); *C11D 1/008* (2013.01); *C11D 1/72* (2013.01); *C11D 1/8255* (2013.01); *C11D 3/18* (2013.01); *C11D 3/2068* (2013.01); *C11D 3/245* (2013.01); *C11D 3/3707* (2013.01); *C11D 3/3757* (2013.01); *C11D 11/0023* (2013.01); *C11D 17/003* (2013.01)

(58) Field of Classification Search

CPC .. C11D 1/00; C11D 1/72; C11D 1/722; C11D 3/2065; C11D 3/245; C11D 3/3707; C11D 7/30; C11D 17/0043

See application file for complete search history.

(56) References Cited

U.S. PATENT DOCUMENTS

| | | | |
|---|---|---|---|
| 3,578,499 | A | 5/1971 | Crotty et al. |
| 3,681,141 | A | 8/1972 | Muoio |

(Continued)

FOREIGN PATENT DOCUMENTS

| | | |
|---|---|---|
| AU | 81384-91 | 11/1991 |
| DE | 35 27 974 | 8/1994 |

(Continued)

OTHER PUBLICATIONS

Abstract of JP A-6-141797 (1985).

(Continued)

*Primary Examiner* — Brian P Mruk

(57) ABSTRACT

Cleaning compositions, which are typically self-adhering in gel form upon application to a hard surface, and which are desirably capable of being applied in aerosol form, are provided. The aqueous-based cleaning compositions include an adhesion promoter, which typically includes one or more organic molecules, each containing at least one hydrophilic group; and an anionic, nonionic, cationic, amphoteric and/or zwitterionic surfactant; and (c) a propellant. In many embodiments, the aqueous-based composition and propellant are contained within a single compartment of a dispensing device.

30 Claims, 2 Drawing Sheets

(51) Int. Cl.

| | |
|---|---|
| ***C11D 3/24*** | (2006.01) |
| ***C11D 3/37*** | (2006.01) |
| ***C11D 3/18*** | (2006.01) |
| ***C11D 1/825*** | (2006.01) |
| ***C11D 11/00*** | (2006.01) |

(56) References Cited

U.S. PATENT DOCUMENTS

| | | | |
|---|---|---|---|
| 3,955,986 | A | 5/1976 | Miller |
| 4,578,207 | A | 3/1986 | Holdt et al. |
| 4,911,858 | A | 3/1990 | Bunczk et al. |
| 5,047,167 | A | 9/1991 | Steyn et al. |
| 5,254,290 | A | 10/1993 | Blandizux et al. |
| 5,336,427 | A | 8/1994 | Bunczk et al. |
| 5,364,551 | A | 11/1994 | Lentsch et al. |
| 5,460,742 | A | 10/1995 | Cavanagh et al. |
| 5,466,395 | A | 11/1995 | Tosaka et al. |
| 5,472,629 | A | 12/1995 | Lysy et al. |
| 5,562,850 | A | 10/1996 | Woo et al. |
| 5,579,842 | A | 12/1996 | Riley |
| 5,591,376 | A | 1/1997 | Kiewert et al. |
| 5,597,793 | A | 1/1997 | Besse et al. |
| 5,705,470 | A | 1/1998 | Faris |
| 5,849,310 | A | 12/1998 | Trinh et al. |
| 5,877,135 | A | 3/1999 | Hahn |
| 5,948,741 | A | 9/1999 | Ochomogo et al. |
| 5,948,742 | A | 9/1999 | Chang et al. |
| 5,985,808 | A | 11/1999 | He et al. |
| 6,080,387 | A | 6/2000 | Zhou et al. |
| 6,087,309 | A | 7/2000 | Vinson et al. |
| 6,150,318 | A | 11/2000 | Silvester et al. |
| 6,284,077 | B1 | 9/2001 | Lucas et al. |
| 6,336,977 | B1 | 1/2002 | Menke et al. |
| 6,358,907 | B1 | 3/2002 | Vitomir et al. |
| 6,395,794 | B2 | 5/2002 | Lucas et al. |
| 6,407,051 | B1 | 6/2002 | Smith et al. |
| 6,425,406 | B1 | 7/2002 | Klinkhammer et al. |
| 6,482,392 | B1 | 11/2002 | Zhou et al. |
| 6,491,933 | B2 | 12/2002 | Lorenzi et al. |
| 6,667,286 | B1 | 12/2003 | Dettinger et al. |
| 6,838,426 | B1 | 1/2005 | Zeilinger |
| 6,914,075 | B2 | 7/2005 | Nakano et al. |
| 6,916,468 | B2 | 7/2005 | Lasota |
| 7,018,970 | B2 | 3/2006 | Hsu et al. |
| 7,199,090 | B2 | 4/2007 | Koivisto et al. |
| 7,727,948 | B2 | 6/2010 | Mock-Knoblauch et al. |
| 7,776,811 | B2 | 8/2010 | Dilley et al. |
| 7,919,447 | B1 | 4/2011 | Klinkhammer et al. |
| 8,093,194 | B2 | 1/2012 | Chapman et al. |
| 8,143,205 | B2 | 3/2012 | Klinkhammer et al. |
| 8,143,206 | B2 | 3/2012 | Klinkhammer et al. |
| 8,158,108 | B2 | 4/2012 | Valpey, III et al. |
| 8,178,078 | B2 | 5/2012 | Clark et al. |
| 8,361,450 | B2 | 1/2013 | Johnson et al. |
| 8,367,048 | B2 | 2/2013 | Wells et al. |
| 8,440,600 | B2 | 5/2013 | Klinkhammer et al. |
| 8,444,771 | B2 | 5/2013 | Leipold et al. |
| 8,461,093 | B2 | 6/2013 | Leipold et al. |
| 8,536,105 | B2 | 9/2013 | Dooley et al. |
| 8,545,815 | B2 | 10/2013 | Valpey, III et al. |
| 8,658,588 | B2 | 2/2014 | Wortley et al. |
| 8,835,371 | B2 | 9/2014 | Leipold et al. |
| 8,865,132 | B2 | 10/2014 | Valpey, III et al. |
| 8,927,474 | B2 | 1/2015 | Shah |
| 8,927,479 | B2 | 1/2015 | Perlas |
| 8,980,813 | B2 | 3/2015 | Klinkhammer et al. |
| 8,993,502 | B2 | 3/2015 | Klinkhammer et al. |
| 9,044,414 | B2 | 6/2015 | Clark et al. |
| 9,102,906 | B2 | 8/2015 | Leipold et al. |
| 9,187,720 | B2 | 11/2015 | Leipold et al. |
| 9,637,902 | B2 | 5/2017 | Burt et al. |
| 9,644,359 | B2 | 5/2017 | Burt et al. |
| 2003/0083210 | A1 | 5/2003 | Goldberg et al. |
| 2003/0125220 | A1 | 7/2003 | Dykstra et al. |
| 2004/0221870 | A1 | 11/2004 | Canoiranzo et al. |
| 2005/0129626 | A1* | 6/2005 | Koivisto ..... A01N 31/02 424/47 |
| 2006/0111262 | A1 | 5/2006 | Conzelmann et al. |
| 2006/0111265 | A1 | 5/2006 | Rypkema et al. |
| 2006/0135393 | A1 | 6/2006 | Molenda |
| 2006/0204526 | A1 | 9/2006 | Lathrop et al. |
| 2009/0215661 | A1 | 8/2009 | Klinkhammer et al. |
| 2009/0215909 | A1 | 8/2009 | Wortley et al. |
| 2009/0325839 | A1 | 12/2009 | Wortley et al. |
| 2010/0093586 | A1 | 4/2010 | Klinkhammer et al. |
| 2012/0108490 | A1 | 5/2012 | Wortley et al. |
| 2012/0172281 | A1 | 7/2012 | Scheibel et al. |
| 2012/0232170 | A1* | 9/2012 | Klinkhammer ..... C11D 3/18 514/789 |
| 2013/0108557 | A1 | 5/2013 | Abram et al. |
| 2014/0037569 | A1 | 2/2014 | Leipold et al. |
| 2014/0196847 | A1 | 7/2014 | Bergherm |
| 2014/0248220 | A1* | 9/2014 | Abram ..... A61K 9/0014 424/45 |
| 2014/0298577 | A1 | 10/2014 | Burt et al. |
| 2014/0356311 | A1 | 12/2014 | Leipold et al. |

FOREIGN PATENT DOCUMENTS

| | | | |
|---|---|---|---|
| EP | 0 631 788 | | 1/1995 |
| EP | 1 447 461 | A1 | 8/2004 |
| EP | 1978080 | A1 | 10/2008 |
| GB | 2 280 906 | | 2/1995 |
| GB | 2 288 186 | | 10/1995 |
| WO | WO-97/05232 | | 2/1997 |
| WO | WO-97/40133 | | 10/1997 |
| WO | WO-02/26925 | | 4/2002 |
| WO | WO-03/066797 | | 8/2003 |
| WO | WO 2011/014241 | * | 2/2011 ..... C11D 1/72 |
| WO | WO 2015/091678 | A1 | 6/2015 |

OTHER PUBLICATIONS

English Abstract for JP 2004-277469 A, Oct. 2004.
English Abstract for JP 2005-179437 A, Jul. 2005.
English Abstract for JP 2014-152280 A, Aug. 2014.
International Search Report and Written Opinion regarding Int'l Appl. No. PCT/US2016/037479 dated Oct. 18, 2016, 16 pages.
International Search Report and Written Opinion for International Application PCT/US2016/037479, dated Oct. 18, 2016, 16 pages.
Abstract of JP-2004-277469-A (pub. Date—Oct. 7, 2004)—3 M Innovative Properties.
Abstract of JP-2005-179437-A (pub. Date—Jul. 7, 2005)—Lion Corp.
Abstract of JP-2014-152280-A (pub. Date—Aug. 25, 2014)—a Dainippon Jochugiku KK.

* cited by examiner

A

B

CLEANING COMPOSITION WITH PROPELLANT

CROSS-REFERENCE TO RELATED APPLICATIONS

This patent application claims the benefit of U.S. Provisional Patent Application 62/193,905, filed on Jul. 17, 2015; the entire contents of which are hereby incorporated by reference, for any and all purposes.

BACKGROUND

Aerosol systems that use a propellant gas to deliver highly viscous products, such as cheese or churro dough (food industry), and caulking materials, are known. Generally, in such applications, the product formulation and propellant gases are physically separated by a barrier, such as a bag. The propellant, which exists outside the bag, pushes on the bag after an aerosol actuator is acted upon to deliver the material contained inside the bag. While this technology (commonly known as bag-in-valve or bag-in-can) has become widely adopted for some products, these non-traditional aerosol components are substantially more expensive and cumbersome to handle in a production line than traditional aerosol dispensers. Thus, due to processing and cost considerations, it would be advantageous to have an aerosol system in which the propellant could be packaged together with a viscous cleaning material in the same compartment of a dispensing device.

SUMMARY

The present application relates generally to the field of cleaning compositions and, in particular, cleaning compositions which may be especially useful for cleaning hard surfaces, such as the inside surface of a toilet bowl. The present application provides cleaning compositions, which are typically self-adhering upon application to a hard surface, such as a vertical or inclined hard surface. The composition commonly is a gel, which may desirably be applied in aerosol form. In order to achieve this method of application, an aqueous-based composition may be packaged together with a propellant in a suitable container. In many embodiments, the aqueous-based composition and propellant are contained within a single compartment of a dispensing device. The propellant is desirably at least partially soluble in the aqueous-based cleaning composition.

The present aqueous-based composition includes water and an adhesion promoter, which typically includes one or more organic molecules, each containing at least one hydrophilic group. The aqueous-based composition commonly also includes at least one surfactant selected from the group of: anionic, nonionic, cationic, amphoteric, and/or zwitterionic surfactants; where one or more of the surfactants may serve all or in part as the adhesion promoter. In some embodiments, the aqueous-based composition may also include a sufficient amount of a basic agent such that an equilibrated mixture of 10 wt. % of the composition with deionized water has a pH of at least about 10.

In the present compositions, the adhesion promoter may include polysaccharide, hydrophilic synthetic polymer and/or an organic molecule(s), which includes one or more one hydrophilic polyalkoxy groups. Suitable examples of organic molecule(s), which contain one or more one hydrophilic polyalkoxy groups include polyethylene glycol, alkoxylated alcohols, alkoxylated polyol partial esters and polymeric alkylene oxide block copolymers. The adhesion promoter may include ethoxylated alcohol(s), ethoxylated polyol partial ester(s) and ethyleneoxide-propyleneoxide block copolymer(s).

The present aqueous-based compositions desirably have a gel melt temperature of about 50-80° C., more commonly about 55-70° C. Quite typically, the present aqueous-based compositions have a viscosity of at least about 150,000 mPs at 25° C. and, often, about 250,000-800,000 mPs at 25° C. Higher viscosity forms of the present aqueous-based cleaning compositions, e.g., those with viscosity of at least about 500,000 mPs at 25° C. and, often, about 600,000-800,000 mPs at 25° C., may desirably have a hardness of at least about 150 g.

In order to facilitate packaging and dispensing aerosol forms of the present cleaning compositions, the present cleaning composition may be formulated with a propellant and the aqueous-based composition in combination, desirably in a single compartment of a dispensing device. For example, the aqueous-based composition may include a propellant, such as a fluorocarbon, hydrofluoroalkane, hydrofluoroalkene and/or volatile ether compound, in direct contact with the composition. In many instances, the propellant is at least partially soluble in the present aqueous-based composition. This can result in a aqueous-based gel cleaning composition being thinned due to the solubilizing effect of propellant dissolving into the gel, while the gel and propellant are in direct contact in the dispensing device. In many instances, this effect can result in the gel being at least partially liquefied by the solubilizing effect of the dissolved propellant. Once dispensed onto a surface under ambient pressure conditions, the propellant largely dissipates and the cleaning composition is deposited in a gel form, which is typically capable of self-adhering to a hard surface.

One embodiment provides a aqueous-based composition for treating a hard surface which includes an adhesion promoter, surfactant and water. The aqueous-based composition is typically packaged with propellant within a single compartment of a dispensing device. The adhesion promoter includes an organic molecule with at least one hydrophilic group. The surfactant is selected from the group consisting of anionic, nonionic, cationic, amphoteric, and zwitterionic surfactants, and combinations thereof, where one or more of the surfactants can serve all or in part as the adhesion promoter. Commonly, the aqueous-based composition is self-adhering upon application to a hard surface. Suitable examples of adhesion promoters include polysaccharides, hydrophilic synthetic polymers and/or organic molecules which includes one or more one hydrophilic polyalkoxy groups. The cleaning composition may also include one or more additional components, such as a polyol humectant (e.g., glycerin), a fragrance component; nonionic surfactant(s), which is different from the adhesion promoter, mineral oil and one or more additional adjuvants.

The propellants contemplated for use in the present compositions may include any type of propellant or mixture of propellants that will aerosolize the aqueous-based composition. Typically, liquid propellants are used to provide such aerosolization. By use of the term "liquid propellant," it is contemplated that such propellant is gaseous at room temperature but at least partially liquefied under pressures found within an aerosol dispensing device.

The propellant selected should also be inert, i.e., it should not react with the components of the aqueous-based composition. Propellants suitable for use in the present composition include non-halogenated hydrocarbons, e.g., propane, dimethyl ether, fluorocarbon and/or hydrofluorocarbon propellants. Commonly, the present aqueous-based compositions may be packaged with dimethyl ether and/or hydrofluorocarbon propellant. Mixtures of these various propellants are also acceptably included in the present compositions.

The quantity of propellant utilized will vary based upon the specific aerosol composition formulated and its physical characteristics. The proportions of the ingredients in the aerosol should be taken into account. Thus, the amount of propellant present should be, as a general rule, that which is sufficient to expel the desired amount of the components from the container. The sufficiency of propellant in an aerosol is typically determined by reference to the vapor pressure inside the aerosol container. Generally, when the vapor pressure reaches a range of about 40 to 120 psig, commonly about 50 to 100 psig at 70° F., a sufficient amount of propellant has been introduced into the dispenser. Typically, the pressure in the dispensing container resulting from the vapor pressure of the propellant may range from about 50 to 80 psig at 70° F.

In order to reach the aforesaid pressures, the propellant is typically present in an amount ranging from about 2 to 25 wt. %, and commonly from about 5 to 20 wt. %, of the total material introduced into the container. The use of dimethyl ether may require that a greater amount of propellant be included in the container than if other propellants are used. This is due to dimethyl ether's characteristic lowering of the vapor pressure upon exposure to the organic solvents and/or other organic materials.

In some embodiments, the present compositions may provide consumers with the benefit of delivering an active ingredient to a relatively wide area of a toilet bowl or other hard surface. In some embodiments, improved stability of a self-adhering composition may be achieved through the inclusion in the composition of certain blends of ethoxylated alcohol(s) together with a polymeric alkyleneoxide block copolymer, e.g., a ethyleneoxide-propyleneoxide block copolymer, or other surfactant. In many embodiments, a dose of the composition on a hard surface (such as the inside surface of a toilet bowl) can partially dissolve during and after each of periodic flows of water (e.g., toilet flushes) thereby providing a wet film, which typically emanates in all directions from the composition over the hard surface. The wet film which emanates from the dose over said hard surface can provide a delivery vehicle for active ingredients in the composition (e.g., cleaning agents, such as detersive surfactants and/or scale dissolving agents) for immediate and residual treatment of the hard surface. The composition may be used to deliver via the wet film at least one active agent present in the composition to extended areas of the hard surface away from the predetermined position of the dose placement.

In one aspect, a method for treating a hard surface using the self-adhering cleaning compositions described herein is also provided. The method typically includes applying a dose of the self-adhering composition directly on the hard surface to be treated, e.g., by dispensing an aerosol form of the composition onto a pre-determined portion of the hard surface. When water is passed over the self-adhering composition and the hard surface, a portion of the self-adhering composition is released into the water that flows over the dose. The portion of the self-adhering composition that is released into the flowing water may provide a wet film on at least a portion of the hard surface. For example, the method may be used to treat the inside of a toilet bowl. A dose of the self-adhering composition may be applied directly on an inside surface of the toilet bowl. When the toilet is flushed, water passes over the self-adhering dose such that a portion of the self-adhering composition is released into the water that flows through the toilet bowl.

Further, one of skill in the art will appreciate that, when used in conjunction with a metered dispenser, the dispenser may provide doses of the composition in any volume and/or size that is suitable for the intended application. Similarly, the shape of the dispenser may be any shape that is desired. For example, in an exemplary embodiment, a dispenser used to dispense the present gel composition, desirably via an aerosol application. Such a dispenser may be capable of dispensing the composition in a variety of shapes that are desirable for the intended purpose. Nonlimiting examples of cross-sectional shapes may be selected from: squares, circles, triangles, ovals, stars, ring-shaped, and the like.

DETAILED DESCRIPTION

Figure 1:
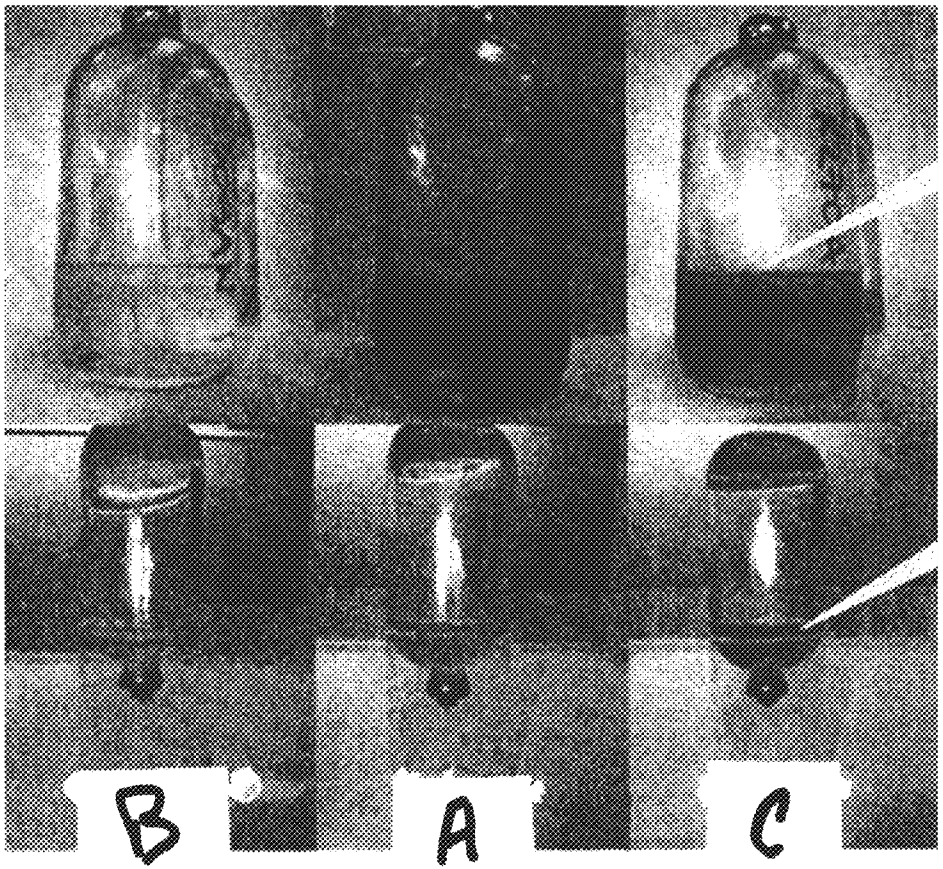
FIG. 1 shows pictures illustrating the amount of dissolution in the presence of the propellant DME (6 g DME; vapor pressure ~61 psig) at room temperature of three cleaning gel formulations (40 g of each) after initial contact with the DME in a closed container, where the top layer is liquid/vapor DME and the bottom layer is solid cleaning gel; and after standing for 24 hours in contact with the DME in the closed container, where a substantial portion (circa half in the case of Formulation C) of the solid gel has liquefied.

In one aspect, the aqueous-based compositions described herein can be combined with the propellant in a suitable container in order to aid delivery and dispersal. The propellant may be a compressed gas (such as an inert compressed gas), a hydrocarbon, a hydrofluoroalkane, a hydrofluoroalkene, a fluorocarbon, a volatile ether compound or any combination thereof. Typically, the propellant includes liquid propellant, such as a fluorocarbon, hydrofluoroalkane, hydrofluoroalkene, volatile ether compound, or any combination thereof. Very often, the propellant includes a volatile ether compound (e.g., dimethyl ether), a hydrofluoroalkane (e.g., and/or) or any combination thereof.

The present aqueous-based compositions commonly include an adhesion promoter, which includes polysaccharide, hydrophilic synthetic polymer and/or an organic compound(s), which includes one or more one hydrophilic polyalkoxy groups. Suitable examples of organic compound(s), which contain one or more one hydrophilic polyalkoxy groups include polyethylene glycol, alkoxylated alcohols, alkoxylated polyol partial esters and polymeric alkylene oxide block copolymers. For example, the adhesion promoter may include ethoxylated alcohol(s), ethoxylated polyol partial ester(s), polyethylene glycol and/or ethyleneoxide-propyleneoxide block copolymer(s).

The present aqueous-based compositions desirably have a gel melt temperature of about 50-80° C., more commonly about 55-70° C. Quite typically, the present aqueous-based compositions have a viscosity of at least about 150,000 mPs at 25° C. and, often, about 250,000-800,000 mPs at 25° C. Higher viscosity forms of the present aqueous-based compositions, e.g., those with viscosity of at least about 500,000 mPs at 25° C. and, often, about 600,000-800,000 mPs at 25°

C., may desirably have a hardness of at least about 150 g. In many embodiments the aqueous-based compositions are in gel form having a viscosity of about 300,000-700,000 mPs at 25° C.

In one aspect, the aqueous-based compositions described herein can be combined with the propellant in a suitable container in order to aid dispersal. The propellant may be a compressed gas (preferably an inert compressed gas), a hydrofluoroalkane, a hydrofluoroalkene, a fluorocarbon, a volatile ether compound or any combination thereof. Typically, the propellant includes fluorocarbon, hydrofluoroalkane, hydrofluoroalkene, volatile ether compound, or any combination thereof.

The propellant selected should also be inert, i.e., it should not react with the components of the aqueous-based composition. Propellants suitable for use in the present composition include non-halogenated hydrocarbons, e.g., methane, ethane, propane, butane, isobutane, as well as volatile ether compounds such as dimethyl ether. Fluorocarbon and/or hydrofluorocarbon propellants may also be used. Mixtures of these various propellants are also acceptably included in the present compositions.

One suitable propellant is dimethyl ether due to its water solubility. Dimethyl ether has recently become commercially available as a propellant in aerosol systems, e.g., as Dymel® A (E. I. du Pont de Nemours & Co. —"DuPont") and is the preferred propellant due to its water solubility. It has been found useful, not only as a major proportion of the propellant phase for efficient atomization of the present cleaning compositions for application purposes, but also because it may provide excellent co-solvency in conjunction with the specific water-soluble organic solvents and/or other constituents of the cleaning compositions.

Examples of suitable hydrofluoroalkanes include, but are not limited to, difluoromethane, sometimes known as HFC-32; pentafluoroethane, sometimes referred to as HFC-125; 1,1,1,2-tetrafluoroethane, sometimes referred to as HFC-134a (sold by DuPont under the product name Dymel® 134a); 1,1-difluoroethane, sometimes referred to as HFC-152; 1,2-difluoroethane, sometimes referred to as HFC-152a (sold by DuPont under the product name Dymel® 152a); 1,1,1,2,3,3,3-heptafluoropropane, sometimes referred to as HFC-227ea; 1,1,1,3,3,3-hexafluoropropane, sometimes referred to as HFC-236fa; or a mixture thereof.

Examples of hydrofluoroalkenes include, but are not limited to, trans-1,3,3,3-tetrafluoroprop-1-ene, sometimes referred to as HFO-1234ze, or 2,3,3,3-tetrafluoropropene, sometimes referred to as HFO-1234yf, or a mixture thereof.

Examples of suitable volatile ether compound include, but are not limited to, alkyl ethers, such as dimethyl ether (also known as Dymel® A), and fluorinated ethers. Examples of suitable fluorinated ethers include, but are not limited to, 2-(difluoromethoxy)-1,1,1,2-tetrafluoro-ethane (also known as Desflurane), 1,1,1,3,3,3-Hexafluoro-2-(fluoromethoxy) propane (also known as Sevoflurane), bis(2,2,2-trifluoroethyl) ether (also known as Flurothyl), $CF_3$-0-C $F_3$ (also known as E-116), $HCF_2$-0-$CF_2H$ (also known as E-134), $HCF_2$-0-$CFH_2$ (also known as E-143) and $CF_3$-0-$CF_2H$ (also known as E-125).

The amount of propellant that can be used can vary depending upon the components in the composition, the internal volume of the pressurized container, and the rate of mixing between the composition and propellant. In one aspect, the amount of propellant introduced into the pressurized delivery device produces a vapor pressure from about 30 to 150, from about 40 to 120, from about 50 60 to 90, or about between 55 to 80 psi at 72° F. (~22° C.). In another aspect, amount of the propellant is from about 5 to 20 wt. % of the total amount of the composition—and commonly about 10 to 15 wt. %. The compositions can be packaged in an industry standard pressurized delivery device such as, for example, aerosol cans or propane type cylinders fitted with a suitable valve system and nozzle. Depending upon the type and amount of propellant used, the propellant may also act as a solvent, where it can dilute and/or thin the remaining components in the composition.

The compositions when formulated to contain propellant commonly possess good release and spray properties when dispensed from the pressurized delivery device. The compositions maintain a relatively low internal pressure in the pressurized delivery device, which is desirable with respect to releasing and delivering an adhesive gel from the device in a consistent and even manner. In one aspect, spray out pressure fluctuation is between 0-60 psi at 72° F., or between 0-20 psi at 72° F., and preferably between 0-10 psi at 72° F.

In certain aspects, the present cleaning compositions may include propellant in direct contact with an aqueous-based composition, which includes adhesion promoter, such as an alkoxylated alcohol, polyol humectant, mineral oil, polyethyleneglycol and water. The aqueous-based composition may also include an anionic surfactant (such as a ethoxylated fatty alcohol sulfate and/or sulfonate ester), fragrance and/or a $C_{10}$-$C_{15}$ fatty alcohol. For example, cleaning composition may include propellant and an aqueous-based composition, which includes ethoxylated alcohol, anionic sulfate ester (such as sodium laureth sulfate), glycerin, mineral oil, polyethyleneglycol and water. In an exemplary embodiment, the aqueous-based composition is a gel (in the absence of propellant) which includes about 20-35 wt. % of an ethoxylated $C_{14}$-$C_{22}$ fatty alcohol having an average of 15 to 40 ethylene oxide units; about 10-25 wt. % sodium laureth sulfate; about 2-10 wt. % glycerin; about 0.5-5 wt. % polyethyleneglycol; about 0.5-3 wt. % mineral oil; and at least about 40 wt. % water. Such aqueous-based compositions may also include about 1-10 wt. % of a fragrance component.

In certain aspects, the present cleaning compositions may include propellant in direct contact with an aqueous-based composition, which includes adhesion promoter, such as an alkoxylated fatty alcohol, polyol humectant, hydrophilic polyacrylate copolymer, ethoxylated $C_{10}$-$C_{15}$ alcohol nonionic surfactant, and water. The aqueous-based composition may also include fragrance, polyethyleneglycol and/or mineral oil. For example, cleaning composition may include propellant and an aqueous-based composition, which includes ethoxylated alcohol (e.g., an ethoxylated $C_{14}$-$C_{22}$ fatty alcohol having an average of 15 to 40 ethylene oxide units), glycerin, an ethoxylated $C_{10}$-$C_{15}$ alcohol having an average of 2 to 5 ethylene oxide units, an amphoteric polyacrylate copolymer containing pendent quaternary ammonium groups (e.g., MIRAPOL SURF S available from Rhodia), and water. In an exemplary embodiment, the aqueous-based composition is a gel (in the absence of the propellant) which includes about 20-35 wt. % of an ethoxylated $C_{14}$-$C_{22}$ fatty alcohol having an average of 15 to 40 ethylene oxide units; about 1-5 wt. % of the ethoxylated $C_{10}$-$C_{15}$ alcohol; about 2-10 wt. % glycerin; about 0.5-2 wt. % of the amphoteric polyacrylate copolymer and at least about 40 wt. % water. Such aqueous-based compositions may also include about 1-10 wt. % of a fragrance component, about 0.5-5 wt. % polyethyleneglycol and/or about 0.5-3 wt. % mineral oil.

In certain aspects, the cleaning compositions include an alkoxylated alcohol (e.g., ethoxylated alcohol), polymeric alkyleneoxide block copolymer (e.g., a ethyleneoxide-propyleneoxide block copolymer), mineral oil, and water. In some embodiments, the cleaning compositions may include one or more additional components, such as a natural or synthetic polymer resin, a polyol humectant (such as glycerin, sorbitol, and/or other sugar alcohol), and/or an anionic and/or amphoteric surfactant and/or nonionic surfactant which is not an alkoxylated alcohol. Optionally, the cleaning compositions may also include one or more adjuvants, such as a fragrance, a complexing agent, and/or a bleaching agent. The alkoxylated alcohol component may include a mixture of ethoxylated alcohols having varying degrees of ethoxylation. For example, the ethoxylated alcohol component may include an ethoxylated $C_{14}$-$C_{30}$ alcohol having an average of about 20 to 50 ethylene oxide units and an ethoxylated $C_8$-$C_{15}$ alcohol having an average of about 5 to 15 ethylene oxide units. In some embodiments, such compositions may be a gel having a hardness of at least about 150 g and/or a gel melt temperature of about 50-80° C.

In another aspect, the cleaning composition may include an adhesive cleaning composition in which the adhesion promoter includes a ethoxylated alcohol, e.g., an ethoxylated $C_{12}$-$C_{30}$ alcohol having an average of 15 to 50 ethylene oxide units, ethyleneoxide-propyleneoxide block copolymer, mineral oil, and water. In some embodiments, the cleaning composition may include about 15-40 wt. % of a first ethoxylated alcohol, which is an ethoxylated $C_{14}$-$C_{30}$ alcohol having an average of 20 to 50 ethylene oxide units; about 1-15 wt. % ethyleneoxide-propyleneoxide block copolymer; about 0.5-10 wt. % mineral oil; and water. The cleaning composition may often also include an ethoxylated $C_8$-$C_{15}$ alcohol having an average of about 5 to 15 ethylene oxide units.

In certain aspects, the present cleaning compositions may include propellant in direct contact with an aqueous-based composition, which includes adhesion promoter, such as an alkoxylated fatty alcohol, polyol humectant, mineral oil, cationic surfactant, and water. Such aqueous-based compositions may also include a fragrance component and/or other additives. For example, cleaning composition may include propellant and an aqueous-based composition, which includes ethoxylated alcohol (e.g., an ethoxylated $C_{14}$-$C_{22}$ fatty alcohol having an average of 15 to 40 ethylene oxide units), glycerin, mineral oil, a cationic surfactant such as an alkylpolyglucoside derivative having pendent quaternary ammonium groups, and water. In an exemplary embodiment, the aqueous-based composition is a gel (in the absence of the propellant) which includes about 20-35 wt. % of an ethoxylated $C_{14}$-$C_{22}$ fatty alcohol having an average of 15 to 40 ethylene oxide units; about 0.5-3 wt. % mineral oil; about 2-10 wt. % glycerin; about 1-5 wt. % of the alkylpolyglucoside derivative; and at least about 40 wt. % water. Such aqueous-based compositions may also include about 1-10 wt. % of a fragrance component.

In certain aspects, the present cleaning compositions may include propellant in direct contact with an aqueous-based composition, which includes adhesion promoter, such as an alkoxylated fatty alcohol, an anionic surfactant (such as a ethoxylated fatty alcohol sulfate and/or sulfonate ester), polyol humectant, mineral oil, hydrophilic polyacrylate copolymer, and water. The aqueous-based composition may also include a fragrance component. For example, cleaning composition may include propellant and an aqueous-based composition, which includes ethoxylated alcohol (e.g., an ethoxylated $C_{14}$-$C_{22}$ fatty alcohol having an average of 15 to 40 ethylene oxide units), anionic sulfate ester (such as sodium laureth sulfate), glycerin, mineral oil, an amphoteric polyacrylate copolymer containing pendent quaternary ammonium groups (e.g., MIRAPOL SURF S available from Rhodia), and water. In an exemplary embodiment, the aqueous-based composition is a gel (in the absence of the propellant) which includes about 20-35 wt. % of an ethoxylated $C_{14}$-$C_{22}$ fatty alcohol having an average of 15 to 40 ethylene oxide units; about 10-25 wt. % sodium laureth sulfate; about 0.1-3 wt. % of the amphoteric polyacrylate copolymer; about 2-10 wt. % glycerin; about 1-3 wt. % mineral oil; and at least about 40 wt. % water. Such aqueous-based compositions may also include about 1-10 wt. % of a fragrance component.

The present compositions may also include a surfactant selected from nonionic, anionic, cationic, zwitterionic and/or amphoteric surfactants and mixtures thereof; wherein the surfactant is different from the adhesion promoter. In some embodiments, the composition may include up to about 20 wt. %, about 0.1 wt. % to 15 wt. %, about 0.5 to 10 wt. %, about 1 to about 5 wt. %, or about 10 to 20 wt. % of the surfactant. The surfactants may include one or more alkoxylated alcohols that are different from the adhesion promoter. The alkoxylated alcohol may include one or more ethoxylated alcohols. The ethoxylated alcohol may be linear or branched. In some embodiments, the ethoxylated alcohol may include a $C_8$-$C_{16}$ alcohol having an average of 5 to 15 ethylene oxide units, more commonly 5 to 12 ethylene oxide units. Typically, when present, the ethoxylated alcohol includes a $C_9$-$C_{15}$ linear and/or branched alcohol having an average of 5 to 12 ethylene oxide units. A non-limiting example is Genapol® X-100 (available from CLARIANT), which is a branched iso-$C_{13}$ alcohol ethoxylate having an average of 10 ethylene oxide units.

Other ethoxylated alcohols that may be present in the present cleaning compositions as a nonionic surfactant include linear or branched ethoxylated alcohols including a $C_5$-$C_{15}$ alcohol having an average of 4 to 12 ethylene oxide units. Nonlimiting examples include Tomadol® 91-6—a $C_9$-$C_{11}$ ethoxylated alcohol having an average of 6 ethylene oxide units (available from Air Products and Chemicals, Inc.), LUTENSOL® AO-8—a synthetic $C_{13}$-$C_{15}$ ethoxylated oxo alcohol having an average of 8 ethylene oxide units (available from BASF), Genapol® LA 070S—an ethoxylated lauryl alcohol having an average of 7 ethylene oxide units (available from CLARIANT), and TERGITOL™ 15-S-7, a branched secondary ethoxylated alcohol with 7 ethylene oxide units (available from DOW Chemical). Other examples of suitable ethoxylated linear alcohols include ethoxylated linear alcohols having a $C_{10}$-$C_{15}$ n-alkyl group, e.g., having an average of 5 to 12 ethylene oxide units. Nonlimiting examples include LUTENSOL® TDA 10 (available from BASF)—an ethoxylated tridecyl alcohol having an average of 10 EO groups.

Other nonionic surfactants which may be present include, but are not limited to, secondary ethoxylated alcohols, such as $C_{11}$-$C_{15}$ secondary ethoxylated alcohols. Secondary ethoxylated alcohols suitable for use are sold under the tradename TERGITOL® (available from Dow Chemical). For example TERGITOL® 15-S, more particularly TERGITOL® 15-S-12 is a $C_{11}$-$C_{15}$ secondary ethoxylate alcohol having an average of about 12 ethylene oxide groups.

Other exemplary useful nonionic surfactants include a variety of known nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic surfactant compound with varying degrees of water solubility—depending on the relative length of the hydrophobic and hydrophilic polyethylenoxy elements. Exemplary nonionic compounds include the polyoxyethylene ethers of alkyl aromatic hydroxy compounds, e.g., alkylated polyoxyethylene phenols, polyoxyethylene ethers of long chain aliphatic alcohols (e.g., ethoxylated alcohols), the polyoxyethylene ethers of hydrophobic propylene oxide polymers, and the higher alkyl amine oxides.

Further nonionic surfactants which may be optionally present in the compositions are alkyl polyglycosides (e.g. Glucopon® 425N). Suitable alkyl polyglycosides include known nonionic surfactants which are alkaline and electrolyte stable. Alkyl mono and polyglycosides are generally prepared by reacting a monosaccharide, or a compound hydrolyzable to a monosaccharide with an alcohol such as a fatty alcohol in an acid medium. The fatty alcohol may have from about 8 to 30 and typically 8 to 18 carbon atoms. Examples of such alkylglycosides include, APG 325 CS GLYCOSIDE which is reported to be a 50% $C_9$-$C_{11}$ alkyl polyglycoside (commercially available from Henkel Corp, Ambler Pa.) and GLUCOPON® 625 CS which is reported to be a 50% $C_{10}$-$C_{16}$ alkyl polyglycoside. In some embodiments, the nonionic surfactant may include an alkylpolyglycoside and/or an ethoxylated $C_8$-$C_{15}$ alcohol having an average of 5 to 12 ethylene oxide units.

Alkylpolyglycosides suitable for use in the present compositions may have the formula:

$$RO—(R'O)_x—Z_n$$

where R is a monovalent aliphatic radical containing 8 to 20 carbon atoms (the aliphatic group may be straight or branched, saturated or unsaturated), R' is a divalent alkyl radical containing 2 to 4 carbon atoms, preferably ethylene or propylene, x is a number having an average value of 0 to about 12, Z is a reducing saccharide moiety containing 5 or 6 carbon atoms, such as a glucose, galactose, glucosyl, or galactosyl residue, and n is a number having an average value of about 1 to 10. Some exemplary alkyl polyglycosides are sold under the name GLUCOPON® (where Z is a glucose moiety and x=0).

Additional suitable nonionic surfactants include linear alkyl amine oxides. Typical linear alkyl amine oxides include water-soluble amine oxides of the formula $R^1$—N($R^2$)($R^2$)($R^3$)O where $R^1$ is typically a $C_8$-$C_{18}$ alkyl moiety and the $R^2$ and $R^3$ moieties are typically selected from the group consisting of hydrogen, $C_1$-$C_3$ alkyl groups, and $C_1$-$C_3$ hydroxyalkyl groups. Quite often, $R^1$ is a $C_8$-$C_{18}$ n-alkyl and $R^2$ and $R^3$ are methyl, ethyl, propyl, isopropyl, 2-hydroxethyl, 2-hydroxypropyl, and/or 3-hydroxypropyl. The linear amine oxide surfactants in particular may include linear $C_{10}$-$C_{18}$ alkyl dimethyl amine oxides and linear $C_8$-$C_{12}$ alkoxy ethyl di(hydroxyethyl) amine oxides. Particularly suitable amine oxides include linear $C_{10}$, linear $C_{10}$-$C_{12}$, and linear $C_{12}$-$C_{14}$ alkyl dimethyl amine oxides. Other examples of amine oxide nonionic surfactants include alkyl amidopropyl amine oxides, such as lauryl/myristyl amidopropyl amine oxides (e.g., lauryl/myristyl amidopropyl dimethylamine oxide).

Additional suitable nonionic surfactants include polyethoxylated fatty esters. These include, for example, polyethoxylated sorbitan monooleate, sorbitan monolaurate, sorbitan monopalmitate and/or sorbitan monostearate, and polyethoxylated castor oil. Specific examples of such surfactants are the products of condensation of ethylene oxide (e.g., 10-25 moles) with sorbitan monooleate and condensation of ethylene oxide (e.g., 20-40 moles) with castor oil.

The composition may further include one or more of mineral oil, polyol humectant, and adjuvants. In some embodiments, the composition may further include one or more of mineral oil, polyol humectant, an antimicrobial agent, and a fragrance component. In some embodiments, the composition may include up to about 10 wt. %, about 0.1 to 5 wt. %, or about 0.2 to 3 wt. % mineral oil.

Examples of suitable polyol humectants include glycerin, glycols, such as ethylene glycol, propylene glycol, diethylene glycol, dipropylene glycol, butylene glycol and the like, sugar alcohols such as sorbitol, xylitol, and maltitol, sugars such as glucose, galactose, or compounds with glucosyl or galactosyl residues, and mixtures thereof. In some embodiments, the composition may include 0 wt. % to about 20 wt. % of a polyol humectant or more preferably about 1 wt. % to 10 wt. %. In some embodiments, the composition may include about 1 wt. % to 10 wt. % or about 1 wt. % to 5 wt. % glycerin.

As used herein, adjuvants include components or agents, such as additional functional materials. In some embodiments, the functional materials may be included to provide desired properties and functionalities to the cleaning composition. For the purpose of this application, the term "functional materials" include a material that when dispersed or dissolved in a concentrate and/or use solution, such as an aqueous solution, provides a beneficial property in a particular use. The present compositions may optionally include other soil-digesting components, surfactants, disinfectants, detergent fillers, sanitizers, acidulants, complexing agents, biocides and/or antimicrobial agents, corrosion inhibitors, anti-redeposition agents, foam inhibitors, opacifying agents such as titanium dioxide, dyes, bleaching agents (hydrogen peroxide and other peroxides), enzymes, enzyme stabilizing systems, builders, thickening or gelling agents, wetting agents, dispersants, stabilizing agents, dispersant polymers, cleaning compounds, pH adjusting agents (acids and alkaline agents), stain preventers, and/or fragrances. In some embodiments, the composition may include up to about 10 wt. %, about 1 wt. % to 10 wt. %, or about 2 wt. % to 8 wt. % of a fragrance component.

Examples

The following examples are intended to more specifically illustrate the present cleaning compositions according to various embodiments described above. These examples should in no way be construed as limiting the scope of the present technology.

Table 1 below shows the composition of a number of exemplary formulations of cleaning gels according to the present application. The gel points and viscosities (in kcP at 30° C.) for the corresponding formulation without any added propellants are listed in the Table.

FIG. 1 shows pictures of cleaning gel formulations (A), (B) and (C) after initial contact with the propellant DME in a closed, clear glass container (top row) and after standing for 24 hours contact with DME in the closed container (bottom row). The contents of each container included about 40 g of the aqueous-based gel formulations and about 6 g DME. The vapor pressure in each container resulting primarily from the DME was about 61 psig. As shown, after being in contact with the organic ether propellant for 24 hours, a portion of the propellant dissolved in the gel causing a substantial amount of the gel to liquefy. The liquefied gel can be dispensed from the container as an aerosol driven by the pressurized DME vapor above the gel. Dollops of the cleaning gel formulations deposited on the inner surface of a toilet bowl in this manner, adhere to the surface and are capable of maintaining adherence while slowly dissolving when subjected to 15 flushes per day over a period of several days.

Figure 2:
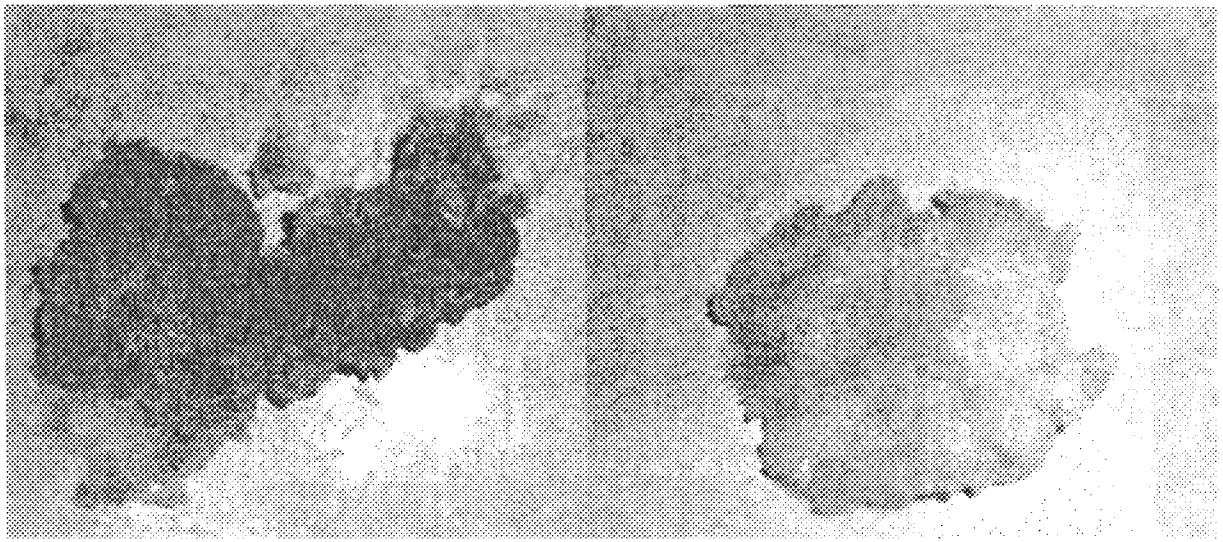
FIG. 2 shows pictures of dollops of two cleaning gel formulations as an aerosol formulation driven by pressurized DME vapor above the gel within the dispenser headspace, where the gel, solubilized with DME, is dispensed and attaches to a surface in a solid fashion.

FIG. 2 shows pictures of dollops of two of the cleaning gel formulations after dispensing as an aerosol formulation driven by the pressurized DME vapor above the gel within the dispenser headspace. The dollop shown on the left side of FIG. 2 is from a sample of a gel having a composition like that of Formulation (B). The dollop shown on the right side of FIG. 2 is from a sample of a gel having a composition like that of Formulation (A). The gels are capable of being dispensed in this manner due to the lowered viscosity of the liquefied gel in comparison to its solid state, once a substantial amount of dissolved propellant has dissipated from the gel formulation—either through loss during the aerosol dispensing process or through outgassing of the deposited gel material. In contrast to cleaning gels dispensed with DME and/or Dymel® hydrofluorocarbons, attempts to produce aerosol gels with an LPG (typically a combination of propane, i-butane and n-butane) did not result in solubilization/thinning of the gel material and hence fail to result in dispensing such materials.

TABLE 1

Gel Formulations

| Ingredient | (A) | (B) | (C) |
|---|---|---|---|
| $C_{16}$-$C_{22}$ ROH-30 EO | 25-30 | | |
| $C_{16}$-$C_{18}$ ROH-25 EO | | 25-35 | 25-35 |
| SLES-2 EO | 10-20 | | |
| n-$C_{12/13}$ ROH | 0.1-2 | | |
| i-$C_{13}$ ROH-nEO | | 2-5 | 2-5 |
| Glycerin | 3-8 | 3-8 | 3-8 |
| Mirapol Surf S500 | | 0.5-2 | 0.5-2 |
| Mineral Oil | 0.5-2 | 0.5-2 | |
| Fragrance | 3-10 | 3-10 | 3-10 |
| PEG 6000 | 0.5-3 | | |
| Gel Point (° C.)* | 60-70 | 60-70 | 65-75 |
| Viscosity* (kcP) at 30° C. | 500-700 | 600-800 | 550-750 |

*in absence of propellant

Illustrative Embodiments

Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

One embodiment provides a composition for treating a hard surface comprising an aqueous-based composition which includes water and an adhesion promoter, which comprises an organic molecule with at least one hydrophilic group. A quantity of the resulting composition may be loaded into an aerosol container and charged with an appropriate amount, e.g., about 5 to 20 wt. % and commonly about 10 to 15 wt. % of the propellant. The aqueous-based composition typically also includes at least one surfactant selected from the group consisting of: anionic, nonionic, cationic, amphoteric, zwitterionic, and combinations thereof; wherein one or more of the at least one surfactant can serve all or in part as the at least one adhesion promoter. The aqueous-based composition may also include one or more of: a polyol humectant; a fragrance component; one or more linear primary alcohols, wherein each alcohol includes a carbon chain containing 8 to 15 carbons; and one or more adjuvants. After aerosol application to a hard surface, the composition is commonly in the form of a gel, which is self-adhering to the hard surface. The gel typically has a viscosity 25° C. of at least about 150,000 cP. The gel may have a gel melt temperature of about 55 to 80° C.

In the aqueous-based compositions described above, the adhesion promoter may include the organic compound which includes at least one hydrophilic polyalkoxy group, e.g., polyethylene glycol, an alkoxylated alcohol, an alkoxylated polyol partial ester and/or a polymeric alkylene oxide block copolymer. Commonly, the adhesion promoter includes an ethoxylated $C_{14}$-$C_{22}$ alcohol having an average of 15 to 50 ethylene oxide units and often, includes an ethoxylated linear $C_{14}$-$C_{22}$ primary aliphatic alcohol having an average of 20-35 ethylene oxide units. After dispensing (e.g., upon aerosol application), the composition may provide a gel, which is self-adhering to a hard surface.

In the aqueous-based compositions described above, are advantageously packaged together with a propellant, which includes fluorocarbon, hydrofluoroalkane, hydrofluoroalkene, volatile ether compound, or any combination thereof. The propellant commonly constitutes about 5 to 20 wt. % of the material loaded into the dispensing device and which conversely includes about 80 to 95 wt. % of the aqueous-based composition. Typically, the propellant includes hydrofluoroalkane and/or volatile ether compound (e.g., dimethyl ether). The hydrofluoroalkane may include 1,1,1,2-tetrafluoroethane (Dymel® 134a) and/or 1,1-difluoroethane (Dymel® 152a). In some embodiments, the propellant may include a volatile ether compound, which includes a fluorinated ether.

In some embodiments, a composition for treating a hard surface including an aqueous-based composition, which includes water and an adhesion promoter including a hydrophilic synthetic polymer, is provided. The hydrophilic synthetic polymer may be a polyacrylate, a polyvinyl alcohol, a polyvinyl pyrrolidone, and or a mixture thereof.

In some embodiments, a composition for treating a hard surface including an aqueous-based composition, which includes water and a polysaccharide adhesion promoter, is provided. The polysaccharide may include sodium carboxymethyl cellulose, hydroxyethyl cellulose, hydroxypropyl cellulose, xanthum gum, agar, gelatin gum, acacia gum, carob bean flour, guar gum, or a combination thereof.

In some embodiments, the present aqueous-based compositions may include an adhesion promoter, which includes ethoxylated $C_{14}$-$C_{22}$ alcohol having an average of 15 to 50 ethylene oxide units and an ethyleneoxide-propyleneoxide block copolymer. Such aqueous-based compositions may also include mineral oil; polyol humectant; and optionally, a fragrance component.

In some embodiments, the present aqueous-based compositions may include an adhesion promoter, which includes an ethoxylated $C_{14}$-$C_{22}$ alcohol having an average of 15 to 50 ethylene oxide units; and polyol humectant; hydrophilic polyacrylate; one or more ethoxylated linear primary alcohols having an average of 2 to 10 ethylene oxide units, wherein each alcohol includes a carbon chain containing 8 to 15 carbons; and optionally, a fragrance component.

In some embodiments, the present aqueous-based compositions may include an adhesion promoter, which includes polyethylene glycol and ethoxylated $C_{14}$-$C_{22}$ alcohol having an average of 15 to 50 ethylene oxide units; and polyol humectant; hydrophilic polyacrylate; one or more linear primary alcohols, wherein each alcohol includes a carbon chain containing 8 to 15 carbons; anionic surfactant; and optionally, a fragrance component.

In some embodiments, the present aqueous-based compositions may include an adhesion promoter, which includes ethoxylated alcohol; and the polymeric alkylene oxide block copolymer. The polymeric alkylene oxide block copolymer may comprise ethyleneoxide-propyleneoxide block copolymer, such as EO-PO block copolymer, an EO-PO-EO block copolymer, a $C_8$-$C_{18}$ alcohol EO-PO adduct, a $C_8$-$C_{18}$ alcohol PO-EO adduct and/or an EO-PO dialkyl ether.

In will be readily apparent to one skilled in the art that varying substitutions and modifications may be made to the methods and compositions disclosed herein without departing from the scope and spirit of the invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention. Thus, it should be understood that although the present invention has been illustrated by specific embodiments and optional features, modification and/or variation of the concepts herein disclosed may be resorted to by those skilled in the art, and that such modifications and variations are considered to be within the scope of this invention.

In addition, where features or aspects of the invention are described in terms of Markush groups or other grouping of alternatives, those skilled in the art will recognize that the invention is also thereby described in terms of any individual member or subgroup of members of the Markush group or other group.

Also, unless indicated to the contrary, where various numerical values are provided for embodiments, additional embodiments are described by taking any two different values as the endpoints of a range. Such ranges are also within the scope of the described invention.

What is claimed is:

1. A composition for treating a hard surface comprising (1) an aqueous-based composition which includes:

(a) adhesion promoter, which comprises an organic molecule with at least one hydrophilic group;

(b) at least one surfactant selected from the group consisting of: anionic, nonionic, cationic, amphoteric, zwitterionic, and combinations thereof; wherein one or more of the at least one surfactant can serve all or in part as the at least one adhesion promoter; and (c) water; and (d) propellant, which comprises fluorocarbon, hydrofluoroalkane, hydrofluoroalkene and/or volatile ether propellant;

wherein after aerosol application to a hard surface the composition is in the form of a gel, which is self-adhering to the hard surface; and gel has a viscosity at 25° C. of at least about 150,000 cP.

2. The composition of claim 1, wherein the aqueous-based composition further comprises one or more of:

(e) polyol humectant;

(f) a fragrance component;

(g) one or more linear primary alcohols, wherein each alcohol includes a carbon chain containing 8 to 15 carbons; and (i) one or more adjuvants.

3. The composition of claim 1 wherein the gel has a gel melt temperature of about 55 to 80° C.

4. The composition of claim 3, wherein the adhesion promoter comprises ethoxylated $C_{14}$-$C_{22}$ alcohol having an average of about 15 to 50 ethylene oxide units.

5. The composition of claim 1, wherein the organic molecule includes at least one hydrophilic polyalkoxy group.

6. The composition of claim 5, wherein the organic molecule comprises polyethylene glycol, alkoxylated alcohol, alkoxylated polyol partial ester and/or polymeric alkylene oxide block copolymer.

7. The composition of claim 1, wherein the adhesion promoter comprises ethoxylated alcohol, ethyleneoxide-propyleneoxide block copolymer and/or polyethylene glycol.

8. The composition of claim 1, wherein the adhesion promoter comprises an ethoxylated linear $C_{14}$-$C_{22}$ primary aliphatic alcohol having an average of about 20 to 35 ethylene oxide units.

9. The composition of claim 1, wherein the propellant comprises hydrofluoroalkane.

10. The composition of claim 9, wherein the hydrofluoroalkane comprises 1,1,1,2-tetrafluoroethane and/or 1,1-difluoroethane.

11. The composition of claim 1, wherein the propellant comprises volatile ether compound.

12. The composition of claim 11, wherein the volatile ether compound comprises dimethyl ether.

13. The composition of claim 11, wherein the volatile ether compound comprises a fluorinated ether.

14. The composition of claim 1, wherein the composition contains from about 5 to 25 wt. % of the propellant.

15. The composition of claim 1, wherein the adhesion promoter comprises ethoxylated $C_{14}$-$C_{22}$ alcohol having an average of about 15 to 50 ethylene oxide units and an ethyleneoxide-propyleneoxide block copolymer;

and the composition further comprises mineral oil; polyol humectant; and optionally, a fragrance component.

16. The composition of claim 1, wherein the adhesion promoter comprises ethoxylated $C_{14}$-$C_{22}$ alcohol having an average of about 15 to 50 ethylene oxide units; and the composition further comprises polyol humectant; hydrophilic polyacrylate; one or more ethoxylated linear primary alcohols having an average of 2 to 10 ethylene oxide units, wherein each alcohol includes a carbon chain containing 8 to 15 carbons; and optionally, a fragrance component.

17. The composition of claim 1, wherein the adhesion promoter comprises polyethylene glycol and ethoxylated $C_{14}$-$C_{22}$ alcohol having an average of about 15 to 50 ethylene oxide units; and the composition further comprises polyol humectant; hydrophilic polyacrylate; one or more linear primary alcohols, wherein each alcohol includes a carbon chain containing 8 to 15 carbons; anionic surfactant; and optionally, a fragrance component.

18. The composition of claim 1, wherein the adhesion promoter comprises ethoxylated alcohol and the polymeric alkylene oxide block copolymer.

19. The composition of claim 18, wherein the polymeric alkylene oxide block copolymer comprises ethyleneoxide-propyleneoxide block copolymer.

20. The composition of claim 1 wherein the aqueous-based composition comprises:

ethoxylated $C_{16}$-$C_{22}$ alcohol having an average of 15 to 35 ethylene oxide units;

ethoxylated $C_{10}$-$C_{15}$ alcohol having an average of 2 to 15 ethylene oxide units;

glycerin;

hydrophilic polyacrylate;
a fragrance component; and
at least about 40 wt. % water.

21. The composition of claim 20 wherein the aqueous-based composition further comprises polyethylene glycol and/or mineral oil.

22. The composition of claim 1 wherein the aqueous-based composition comprises:
about 20 to 35 wt. % of an ethoxylated $C_{16}$-$C_{22}$ alcohol having an average of 15 to 35 ethylene oxide units;
about 1 to 5 wt. % of an ethoxylated $C_{10}$-$C_{15}$ alcohol having an average of 2 to 15 ethylene oxide units;
zero to about 5 wt. % polyethylene glycol;
about 0.1 to 2 wt. % mineral oil;
about 2 to 10 wt. % glycerin;
about 0.1 to 2 wt. % hydrophilic polyacrylate;
about 2 to 10 wt. % of a fragrance component; and
at least about 40 wt. % water.

23. The composition of claim 1 wherein the aqueous-based composition comprises:
ethoxylated $C_{16}$-$C_{22}$ alcohol having an average of 15 to 35 ethylene oxide units;
$C_{10}$-$C_{15}$ alcohol having an average of 2 to 15 ethylene oxide units;
glycerin;
anionic surfactant, which includes a sulfate ester of an ethoxylated $C_{10}$-$C_{15}$ alcohol;
mineral oil;
a fragrance component; and water.

24. The composition of claim 1 wherein the aqueous-based composition comprises:
about 20 to 35 wt. % of an ethoxylated $C_{16}$-$C_{22}$ alcohol having an average of 15 to 35 ethylene oxide units;
about 1 to 5 wt. % of an ethoxylated $C_{10}$-$C_{15}$ alcohol having an average of 2 to 15 ethylene oxide units;
zero to about 5 wt. % polyethylene glycol;
about 0.1 to 2 wt. % mineral oil;
about 2 to 10 wt. % glycerin;
about 0.1 to 2 wt. % hydrophilic polyacrylate;
about 2 to 10 wt. % of a fragrance component; and water.

25. An aqueous-based gel comprising:
(a) ethoxylated $C_{14}$-$C_{22}$ alcohol having an average of 15 to 50 ethylene oxide units;
(b) ethoxylated $C_{10}$-$C_{15}$ alcohol having an average of 2 to 15 ethylene oxide units;
(c) polyol humectant;
(c) at least about 40 wt. % water; and
(d) propellant, which comprises hydrofluorocarbon and/or volatile ether propellant;
wherein after aerosol application to a hard surface the gel is self-adhering to the hard surface; and in the absence of the propellant the gel has a viscosity at 30° C. of about 500 to 800 kcP.

26. The composition of claim 1 wherein the aqueous-based composition comprises:
ethoxylated linear $C_{14}$-$C_{22}$ primary aliphatic alcohol having an average of 15 to 35 ethylene oxide units; polyol humectant; and at least about 40 wt. % water;
wherein the propellant comprises dimethyl ether, 1,1,1,2-tetrafluoroethane and/or 1,1-difluoroethane.

27. The composition of claim 25 wherein the gel has a gel melt temperature of about 55 to 80° C.

28. The composition of claim 25, wherein the propellant comprises dimethyl ether, 1,1,1,2-tetrafluoroethane and/or 1,1-difluoroethane.

29. The composition of claim 25, wherein the gel further comprises a fragrance component, mineral oil, a sulfate ester of an ethoxylated $C_{10}$-$C_{15}$ alcohol and/or polyethylene glycol.

30. The composition of claim 29, wherein the gel comprises comprising:
(a) about 20 to 35 wt. % of the ethoxylated $C_{16}$-$C_{22}$ alcohol;
(b) about 1 to 5 wt. % of the ethoxylated $C_{10}$-$C_{15}$ alcohol;
(c) about 2 to 10 wt. % of the polyol humectant, which comprises glycerin;
(d) about 3 to 10 wt. % of the fragrance component; and
(e) about 3 to 10 wt. % of the propellant, which comprises dimethyl ether, 1,1,1,2-tetrafluoroethane and/or 1,1-difluoroethane.

* * * * *